US008183190B2

(12) United States Patent
Zehler et al.

(10) Patent No.: US 8,183,190 B2
(45) Date of Patent: May 22, 2012

(54) COMPLEX POLYOL ESTERS WITH IMPROVED PERFORMANCE

(75) Inventors: Eugene Zehler, West Chester, OH (US); Christopher Costello, Cincinnati, OH (US)

(73) Assignee: Cognis IP Management GmbH, Duesseldorf (DE)

( * ) Notice: Subject to any disclaimer, the term of this patent is extended or adjusted under 35 U.S.C. 154(b) by 1030 days.

(21) Appl. No.: 10/901,578

(22) Filed: Jul. 29, 2004

(65) Prior Publication Data

US 2005/0049153 A1 Mar. 3, 2005

Related U.S. Application Data

(60) Provisional application No. 60/496,535, filed on Aug. 20, 2003.

(51) Int. Cl.
*C10M 105/38* (2006.01)

(52) U.S. Cl. ..... 508/485; 508/492; 508/493; 508/496

(58) Field of Classification Search ..... 508/492, 508/493, 485, 496
See application file for complete search history.

(56) References Cited

U.S. PATENT DOCUMENTS

| | | | | | |
|---|---|---|---|---|---|
| 3,240,703 | A | * | 3/1966 | Symon et al. | 524/368 |
| 3,778,454 | A | * | 12/1973 | Kleiman | 554/227 |
| 3,875,069 | A | * | 4/1975 | Worschech et al. | 508/482 |
| 3,956,154 | A | * | 5/1976 | Marolewski et al. | 252/78.5 |
| 4,366,100 | A | * | 12/1982 | Naskar et al. | 554/166 |
| 4,459,223 | A | | 7/1984 | Shaub et al. | |
| 4,617,134 | A | | 10/1986 | Shaub | |
| 4,636,323 | A | * | 1/1987 | Makino et al. | 508/195 |
| 5,254,466 | A | | 10/1993 | Picataggio et al. | |
| 5,411,672 | A | * | 5/1995 | Kagaya et al. | 508/492 |
| 5,503,762 | A | | 4/1996 | Bongardt et al. | |
| 5,912,214 | A | | 6/1999 | Zehler et al. | |
| 5,994,278 | A | | 11/1999 | Duncan et al. | |
| 6,376,435 | B1 | | 4/2002 | Hafez et al. | |
| 6,828,287 | B1 | * | 12/2004 | Lakes et al. | 508/485 |

FOREIGN PATENT DOCUMENTS

JP 59164393 * 9/1984

OTHER PUBLICATIONS

ASTM Designation: D 6046-02, Standard Classification of Hydraulic Fluids for Environmental Impact, ASTM International, West Conshohocken, PA, (2002), pp. 1-8.

* cited by examiner

*Primary Examiner* — Cephia D Toomer
(74) *Attorney, Agent, or Firm* — DiehlServilla LLC

(57) ABSTRACT

A biodegradable lubricant composition containing a complex polyol ester having a polyfunctional alcohol residue and a saturated or unsaturated dicarboxylic acid residue having from about 9 to about 22 carbon atoms.

20 Claims, No Drawings

COMPLEX POLYOL ESTERS WITH IMPROVED PERFORMANCE

CROSS-REFERENCE TO RELATED APPLICATIONS

This application claims the benefit of copending provisional application Ser. No. 60/496,535 filed on Aug. 20, 2003

STATEMENT REGARDING FEDERALLY SPONSORED RESEARCH OR DEVELOPMENT

Not applicable.

BACKGROUND OF THE INVENTION

There is always a need to develop biodegradable lubricants for use in applications which might result in the leakage of such lubricants into the soil and into waterways, such as rivers, oceans and lakes. Base stocks for biodegradable lubricant applications such as two-cycle engine oils, catapult oils, hydraulic fluids, drilling fluids, water turbine oils, greases, gear lubricants, shock absorber fluids, plasticizers, internal lubricants, and the like have to meet increasingly stringent criteria such as enhanced biodegradability, higher viscosity index, better lubricity, better demulsibility, better additive solubility, lower density, etc. than existing lubricants.

One class of compounds that have the potential of meeting the above requirements are complex esters which are polyol esters of dicarboxylic acids and polyols, especially trifunctional polyols. Examples of such polyols are described in U.S. Pat. No. 5,912,214, the entire contents of which are incorporated herein by reference.

However, it has been found that complex polyol esters which contain short chain dicarboxylic acid residues, such as adipic acid, often exhibit diminished biodegradability, demulsibility, lubricity and additive solubility in the higher viscosity (higher average molecular weight) versions. It has also been observed that complex polyol esters which contain longer chain dicarboxylic acid residues such as "dimer" acid (C36-54 difunctional) often exhibit diminished biodegradability and demulsibility in the higher viscosity (higher average molecular weight) versions.

BRIEF SUMMARY OF THE INVENTION

A lubricant base stock is comprised of a complex polyol ester having a polyfunctional alcohol residue and a saturated or unsaturated dicarboxylic acid residue having from about 9 to about 22 carbon atoms. Such esters are high viscosity esters exhibiting improved biodegradability and viscosity index.

BRIEF DESCRIPTION OF THE SEVERAL VIEWS OF THE DRAWING

Not applicable.

DETAILED DESCRIPTION OF THE INVENTION

Other than in the operating examples, or where otherwise indicated, all numbers expressing quantities of ingredients or reaction conditions are understood as being modified in all instances by the term "about".

The term residue, as used herein, means the portion of a polyol or dicarboxylic acid that remains in the polymer after reaction of the polyol or dicarboxylic acid in the esterification reaction.

Polyols which can be used to make the complex esters according to the invention are those having 2 or more hydroxyl groups. Examples of suitable polyols include, but are not limited to, ethylene glycol, propylene glycol, trimethylol propane, neopentyl glycol, pentaerythritol, dipentaerythritol, and glycerol. A particularly preferred polyol for use in the present invention is trimethylol propane.

Suitable saturated or unsaturated diacids which may be employed include those having from about 9 to about 22 carbon atoms. A particularly preferred diacid for use in the present invention is a saturated or unsaturated $C_{18}$ dicarboxylic acid which can be made from oleic acid by the biooxidation process described in U.S. Pat. No. 5,254,466, the entire contents of which is incorporated herein by reference.

The polyols and diacids are typically employed in a molar ratio of about 0.001-1000: 1, preferably about 0.1-800: 1, and most preferably about 1-500 : 1.

The complex polyol esters according to the invention can be made by the processes described in U.S. Pat. No. 5,912,214, the entire contents of which is incorporated herein by reference. Typically an esterification is carried out in a 4-neck, round bottom flask at 240° C. at atmospheric pressure with overhead stirring, sub-surface nitrogen purge, and a temperature programmed heat source. Water of reaction was drawn off continuously at atmospheric pressure until the reaction was close to completion. Additional water of reaction was drawn off with vacuum at approximately 600 torr. Residual acids were stripped under vacuum at less than 2 torr. Crude esters were produced with an acid value around 3, then optionally refined to an acid value below 0.5 by reaction of the residual acid with a glycidyl ester such as glycidyl neodecanoate. More specifically, an amount of glycidyl ester based on the acid number of the crude ester product is heated to a temperature of about 200° C. for one hour after which the excess glycidyl ester is stripped out of the reaction mixture. The esters according to the invention can also contain monocarboxylic acid residues and mono-alcohol residues.

The complex polyol esters of the present invention will typically be present in lubricant compositions in an amount of from about 0.1 to about 100% by weight, preferably from about 25 to about 100% by weight, and most preferably from about 50 to about 100% by weight, based on the weight of the lubricant composition.

Various additives may also be employed in the lubricant composition of the present invention. Examples thereof include, but are not limited to, extreme pressure additives, anti-foaming agents, pour point depressants, rust or corrosion prevention agents, oxidation inhibitors, detergents, dispersants, smoke-suppression agents, hydrocarbon diluents, stabilizers, dyes, pigments, and mixtures thereof. These additives, if employed, will typically be present in the lubricant composition in an amount of from about 0.1 to about 90% by weight, preferably from about 0.1 to about 60% by weight, and most preferably from about 0.1 to about 30% by weight, based on the weight of the lubricant composition.

The present invention will be better understood from the examples which follow, all of which are intended for illustrative purposes only, and are not meant to limit the invention in any way.

EXAMPLES

Complex polyol esters were prepared and tested for the properties set forth in the tables below. The abbreviation diacid C 18:1 stands for an acid which is primarily a monounsaturated $C_{18}$ dicarboxylic acid, specifically Δ-9-octadecenedioic acid. The abbreviation diacid C 18 stands for an acid which is primarily a saturated $C_{18}$ dicarboxylic acid, specifically octadecanedioic acid. The abbreviation diacid C 9 stands for an acid which is primarily a saturated $C_9$ dicarboxylic acid, specifically nonanedioic (azelaic) acid. TMP is trimethylol propane.

Comparison of Novel C 18 Complex Esters to Existing Products

| | Using C 18:1 Diacid | | Using C 18 Diacid | |
|---|---|---|---|---|
| | Existing Product | New Product | Existing Product | New Product |
| Diacid | C 36-54 | C18:1 | C6 | C18 |
| Monoacid | C18:1 | C18:1 | C 8-10 | C 8-10 |
| Alcohol | TMP | TMP | TMP | TMP |
| Sample Identification | A | B | C | D |
| Viscosity, 40° C., cs | 361.0 | 318.9 | 243.1 | 233.5 |
| Viscosity, 100° C., cs | 44.49 | 43.82 | 27.52 | 30.26 |
| Viscosity Index | 181 | 196 | 148 | 170 |
| Biodegradability, D-5864 | | | | |
| Sample, % degraded | 54.9 | 72.7 | 32.3 | 72.8 |

Comparison of Novel C 9 Complex Esters to Existing Products

| | Using C 9 Diacid | | Using C 9 Diacid | |
|---|---|---|---|---|
| | Existing Product | New Product | Existing Product | New Product |
| Diacid | C 36-54 | C 9 | C 6 | C 9 |
| Monoacid | C18:1 | C18:1 | C 8-10 | C 8-10 |
| Alcohol | TMP | TMP | TMP | TMP |
| Sample Identification | E | F | G | H |
| Viscosity, 40° C., cs | 139 | 135 | 100 | 114 |
| Biodegradability, OECD-301B | | | | |
| Sample, % degraded | 59.0 | 73.1 | 83.0 | 90.3 |

As can be seen from the above-disclosed data, complex polyol esters corresponding to the present invention exhibit a significantly improved biodegradability profile as compared to currently available products.

What is claimed is:

1. A lubricant composition comprising a complex polyol ester, said complex polyol ester consisting of:

(a) an at least trifunctional alcohol residue;

(b) a saturated or unsaturated dicarboxylic acid residue having 18 carbon atoms, and (c) optionally, one or more fatty acid residues selected from the group consisting of C8, C9, C10 and C18 fatty acids, wherein said complex polyol ester exhibits improved biodegradability according to ASTM Standard 0-5864 or OECO Standard 301 B.

2. The composition of claim 1 wherein (a) is derived from a polyol selected from the group consisting of trimethylol propane, pentaerythritol, dipentaerythritol and glycerol.

3. The composition of claim 1 wherein (a) and (b) are present in a molar ratio of about 0.001:1 to about 1000: 1.

4. The composition of claim 1 wherein (a) and (b) are present in a molar ratio of about 1:1 to about 500: 1.

5. The composition of claim 1 further comprising an additive selected from the group consisting of extreme pressure additives, anti-foaming agents, pour point depressants, rust or corrosion prevention agents, oxidation inhibitors, detergents, dispersants, smoke-suppression agents, hydrocarbon diluents, stabilizers, dyes, and pigments.

6. The composition of claim 1 wherein (a) is trimethylol propane.

7. The composition of claim 1 wherein the complex polyol ester is present in the composition in an amount of from about 0.1 to about 100% by weight, based on the weight of the composition.

8. The composition of claim 1 wherein the complex polyol ester is present in the composition in an amount of from about 25 to about 100% by weight, based on the weight of the composition.

9. The composition of claim 1 wherein the complex polyol ester is present in the composition in an amount of from about 50 to about 100% by weight, based on the weight of the composition.

10. A process for enhancing the biodegradability of a lubricant composition comprising the step of adding to a lubricant, a complex polyol ester consisting of:

(a) an at least trifunctional alcohol residue;

(b) a saturated or unsaturated dicarboxylic acid residue having 18 carbon atoms, and (c) optionally, one or more fatty acid residues selected from the group consisting of C8, C9, C10 and C18 fatty acids, wherein said complex polyol ester exhibits improved biodegradability according to ASTM Standard 0-5864 or OECO Standard 301 B.

11. The process of claim 10 wherein (a) is derived from a polyol selected from the group consisting of trimethylol propane, pentaerythritol, dipentaerythritol and glycerol.

12. The process of claim 10 wherein (a) and (b) are present in a molar ratio of about 0.001:1 to about 1000: 1.

13. The process of claim 10 wherein (a) and (b) are present in a molar ratio of about 1:1 to about 500: 1.

14. The process of claim 10 wherein the composition further comprises an additive selected from the group consisting of extreme pressure additives, anti-foaming agents, pour point depressants, rust or corrosion prevention agents, oxidation inhibitors, detergents, dispersants, smoke-suppression agents, hydrocarbon diluents, stabilizers, dyes, and pigments.

15. The process of claim 10 wherein (a) is trimethylol propane.

16. The process of claim 10 wherein the complex polyol ester is present in the composition in an amount of from about 0.1 to less than 100% by weight, based on the weight of the composition.

17. The process of claim 10 wherein the complex polyol ester is present in the composition in an amount of from about 25 to less than 100% by weight, based on the weight of the composition.

18. The process of claim 10 wherein the complex polyol ester is present in the composition in an amount of from about 50 to less than 100% by weight, based on the weight of the composition.

19. The lubricant composition of claim 1, wherein said one or more fatty acid residues (c) are present, and are selected from the group consisting of C8, C9 and C10 fatty acids.

20. The lubricant composition of claim 10, wherein said one or more fatty acid residues (c) are present, and are selected from the group consisting of C8, C9 and C10 fatty acids.

* * * * *